US009322593B2

(12) United States Patent
Cheng

(10) Patent No.: US 9,322,593 B2
(45) Date of Patent: Apr. 26, 2016

(54) UMBRELLA DRAINING ASSEMBLY

(71) Applicant: Li-Hwa Cheng, Taoyuan County (TW)

(72) Inventor: Li-Hwa Cheng, Taoyuan County (TW)

( * ) Notice: Subject to any disclaimer, the term of this patent is extended or adjusted under 35 U.S.C. 154(b) by 150 days.

(21) Appl. No.: 14/305,639

(22) Filed: Jun. 16, 2014

(65) Prior Publication Data

US 2015/0362252 A1 Dec. 17, 2015

(51) Int. Cl.
*F26B 25/08* (2006.01)
*F26B 5/08* (2006.01)

(52) U.S. Cl.
CPC ..... *F26B 5/08* (2013.01)

(58) Field of Classification Search
CPC ..... F26B 5/00; F26B 5/08; F26B 21/00; F26B 21/21; F26B 21/11; F26B 25/00; A01B 12/00; A01B 12/006; A47L 5/38; A46B 9/00; A46B 9/02; B01D 53/18; B01D 53/80; A47F 7/00
USPC ..... 34/58, 104, 105, 107; 15/10, 104.92, 15/160; 211/62; 312/206, 207, 229
See application file for complete search history.

(56) References Cited

U.S. PATENT DOCUMENTS 1,369,603 A * 2/1921 Baity ..... A45B 25/28 135/48
1,476,599 A * 12/1923 De Witt ..... A47G 25/12 211/62
3,136,426 A * 6/1964 Yasuji ..... A47G 25/12 211/62
5,195,550 A * 3/1993 Chan ..... A45B 25/24 135/15.1
5,381,812 A * 1/1995 Lee ..... A45B 25/28 135/15.1
5,566,471 A * 10/1996 Hirano ..... D06F 57/00 160/5
5,625,960 A * 5/1997 Fujita ..... A45B 25/28 135/34.2
5,709,328 A * 1/1998 Ackeret ..... B60R 7/12 211/63
5,938,049 A * 8/1999 Susholz ..... A45B 25/28 211/62

(Continued)

FOREIGN PATENT DOCUMENTS

EP 0689020 A1 * 12/1995 ..... A45B 25/28
GB 2438865 A * 12/2007 ..... F26B 9/003
WO WO 03016806 A1 * 2/2003 ..... F26B 5/12

(Continued)

*Primary Examiner* — Stephen M Gravini
(74) *Attorney, Agent, or Firm* — Schmeiser, Olsen & Watts, LLP

(57) ABSTRACT

An umbrella draining assembly mainly includes a cylindrical containing cistern body, a flinging device disposed in an inner section of the containing cistern body, and a bearing plate disposed at a bottom edge of the containing cistern body. A positioning component is disposed in the containing cistern body. The flinging device includes an embedding section, at an inner edge thereof is disposed a plurality of tapering serrated segments. A transmission component is disposed at a bottom edge of the embedding section. When the umbrella draining assembly is in use, a top shaft of an umbrella is inserted into the embedding section, with the positioning component fixing the position of the umbrella. The transmission component drives the embedding section to rotate quickly, causing rainwater on the umbrella to be flung outward due to centrifugal force and to fall on the bearing plate at a bottom edge of the containing cistern body. The umbrella draining assembly of the present invention drains wet umbrellas carried from outdoor to indoor on rainy days and prevents rainwater thereon to drip on the floor.

3 Claims, 5 Drawing Sheets

(56) References Cited

U.S. PATENT DOCUMENTS 7,124,516 B2 * 10/2006 Shiraishi ..... F26B 5/16 34/103
8,327,558 B2 * 12/2012 Hu ..... D06F 58/14 34/210
8,336,566 B2 * 12/2012 Jarrett ..... A45B 23/00 135/33.2
8,910,392 B2 * 12/2014 Liao ..... F26B 5/08 119/850
2007/0011841 A1 * 1/2007 Kao ..... A47L 23/02 15/310
2011/0154677 A1 * 6/2011 Pudalov ..... F26B 9/003 34/107
2015/0362252 A1 * 12/2015 Cheng ..... F26B 5/08 34/184

FOREIGN PATENT DOCUMENTS

WO WO 2004001307 A1 * 12/2003 ..... F26B 5/16
WO WO 2009130877 A1 * 10/2009 ..... A47G 25/12

* cited by examiner

UMBRELLA DRAINING ASSEMBLY

BACKGROUND OF THE INVENTION

1. Field of the Invention

The present invention relates to an umbrella draining assembly, particularly to an umbrella draining assembly which removes rainwater from wet umbrellas when they are carried from outdoor to indoor on rainy days to prevent rainwater thereon from dripping on the floor.

2. Description of Related Art

On rainy days before we carry wet umbrellas indoors, we would generally shake the dripping umbrellas to remove rainwater thereon. This, however, would not successfully remove all the rainwater on the umbrellas. The remaining rainwater thereon would drip on the floor, wetting the floor and creating puddles of water on the floor, which may lead to unfortunate incidents of people slipping and falling. To deal with this, some businesses, office buildings, and public places would provide their customers or visitors with plastic covers at the entrance for their wet umbrellas. Plastic covers may indeed prevent rainwater from dripping on the floor, but it is neither convenient to use nor eco-friendly. In view of this, after laborious research and experiments, the applicant has devised an umbrella draining assembly which removes rainwater from dripping umbrellas with easy operation when they are carried from outdoor to indoor on rainy days.

SUMMARY OF THE INVENTION

It is an object of the present invention to provide an umbrella draining assembly which removes rainwater from dripping umbrellas with easy operation when they are carried from outdoor to indoor on rainy days to prevent rainwater from dripping on the floor and which does without plastic covers and is eco-friendly The foregoing umbrella draining assembly includes a cylindrical containing cistern body, a flinging device disposed in an inner section of the containing cistern body, and a bearing plate disposed at a bottom edge of the containing cistern body. A positioning component is disposed in the containing cistern body. The flinging device includes an embedding section, at an inner edge thereof is disposed a plurality of tapering serrated segments. A transmission component is disposed at a bottom edge of the embedding section. When the umbrella draining assembly is in use, a top shaft of an umbrella is inserted into the embedding section, with the positioning component fixing the position of the umbrella. The transmission component drives the embedding section to rotate quickly, causing rainwater on the umbrella to be flung outward due to centrifugal force and to fall on the bearing plate at a bottom edge of the containing cistern body. The umbrella draining assembly of the present invention drains wet umbrellas carried from outdoor to indoor on rainy days and prevents rainwater thereon to drip on the floor.

The foregoing umbrella draining assembly, wherein the containing cistern body is composed of two symmetrical semi-circular shell bodies. The two shell bodies are connected on one side to each other and form a unity that can be opened and shut on another side. On another side of one of the shell bodies is disposed a contact switch. When the flinging device is rotating, if the unity of the shell bodies is opened, the contact switch would sense it and cut off power supply to the transmission component to ensure safety.

The foregoing umbrella draining assembly, wherein the positioning component is a crossbar disposed on a sliding bar. On the crossbar is disposed a circular frame whereon is disposed a plurality of symmetrically arrayed flexible guide wheels which clamp and position a support shaft of an umbrella.

BRIEF DESCRIPTION OF THE INVENTION

DETAILED DESCRIPTION OF THE PREFERRED EMBODIMENT

Figure 1:
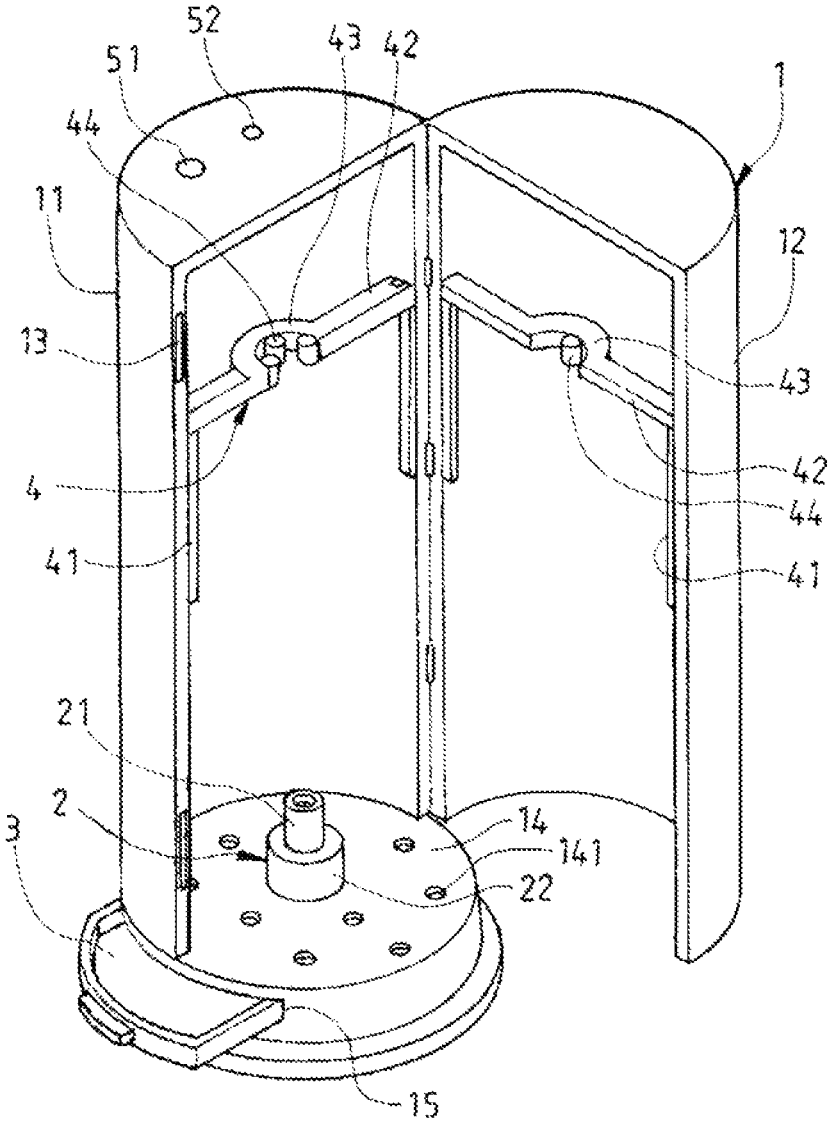
FIG. 1 is a pictorial drawing of the present invention.
Figure 2:
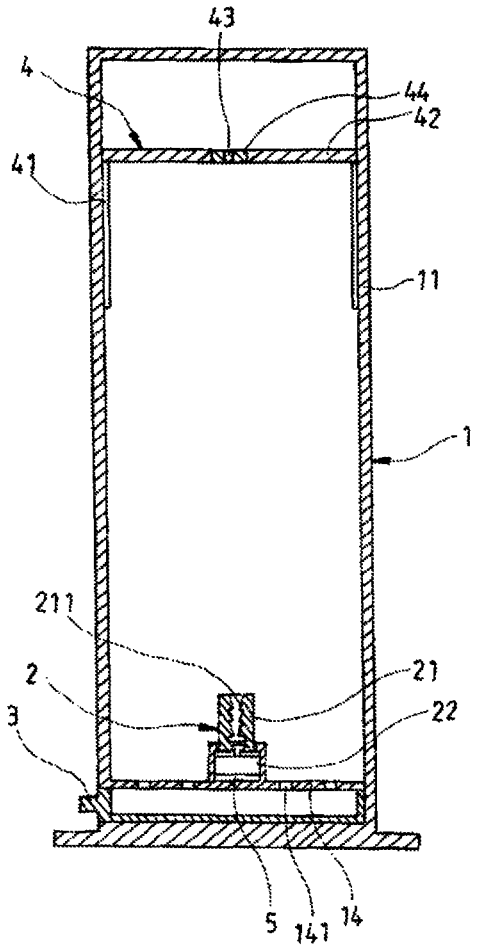
FIG. 2 is a cross-sectional view of the present invention.
Figure 3:
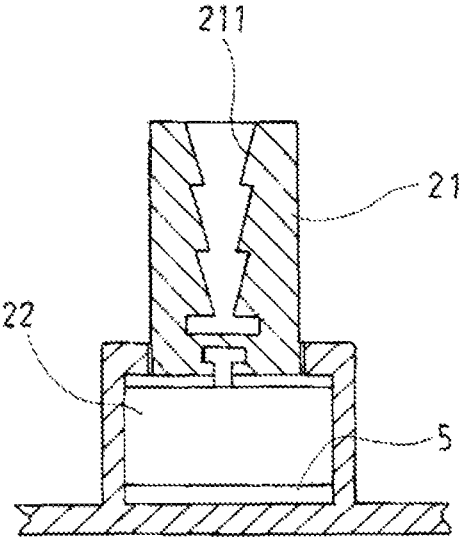
FIG. 3 is a cross-sectional view of the flinging device of the present invention.

Please refer to both FIGS. 1 and 2, along with FIG. 3, showing respectively a pictorial drawing and a cross-sectional view of the present invention, and a cross-sectional view of the flinging device. As these figures show. the present invention includes a cylindrical containing cistern body 1, a flinging device 2 disposed in an inner section of the containing cistern body 1, and a bearing plate 3 disposed at a bottom edge of the containing cistern body 1. The containing cistern body 1 is composed of two symmetrical semi-circular shell bodies 11 and 12. The two shell bodies 11 and 12 are connected on one side to each other and form a unity that can be opened and shut on another side. On another side of the shell body 11 is disposed a contact switch 13. A positioning component 4 is disposed on an inner edge of the containing cistern body 1. In the present preferred embodiment, the positioning component 4 is a crossbar 42 disposed on a sliding bar 41. On the crossbar 42 is disposed a circular frame 43 whereon is disposed a plurality of symmetrically arrayed flexible guide wheels 44. The crossbar 42 may slide up or down along the sliding bar 41 to adjust its level. The flinging device 2 includes an embedding section 21, at an inner edge thereof is disposed a plurality of tapering serrated segments 211. A transmission component 22 is disposed at a bottom edge of the embedding section 21. In the present preferred embodiment, the transmission component 22 is a motor. The transmission component 22 is electrically connected to a control circuit 5. The transmission component 22 and the control circuit 5 are secured on a base plate 14 whereon is disposed a plurality of intervally arranged throughholes 141. The control circuit 5 is electrically connected to the contact switch 13, and a button 51 and a display lamp 52 disposed on a top edge of the shell body 11 of the containing cistern body 1. At a bottom of the containing cistern body 1 is disposed a long opening 15 for the bearing plate 3 to be placed in.

The combination of the above-mentioned elements forms an umbrella draining device. When the umbrella draining assembly is in use, the unity of the two symmetrical semi-circular shell bodies 11 and 12 of the containing cistern body 1 is opened. A top shaft of an umbrella is inserted into the embedding section 21. When the unity of the shell bodies 11 and 12 is closed, the guide wheels 44 of the positioning component 4 fix the position of the umbrella. A press on the button 51 turns on the transmission component 22. which drives the embedding section 21 to rotate quickly. Rainwater on the umbrella is flung outward due to centrifugal force and falls on the bearing plate 3 at a bottom edge of the containing cistern body 1. The umbrella draining assembly of the present invention drains wet umbrellas carried from outdoor to indoor on rainy days and prevents rainwater thereon to drip on the floor.

Figure 4:
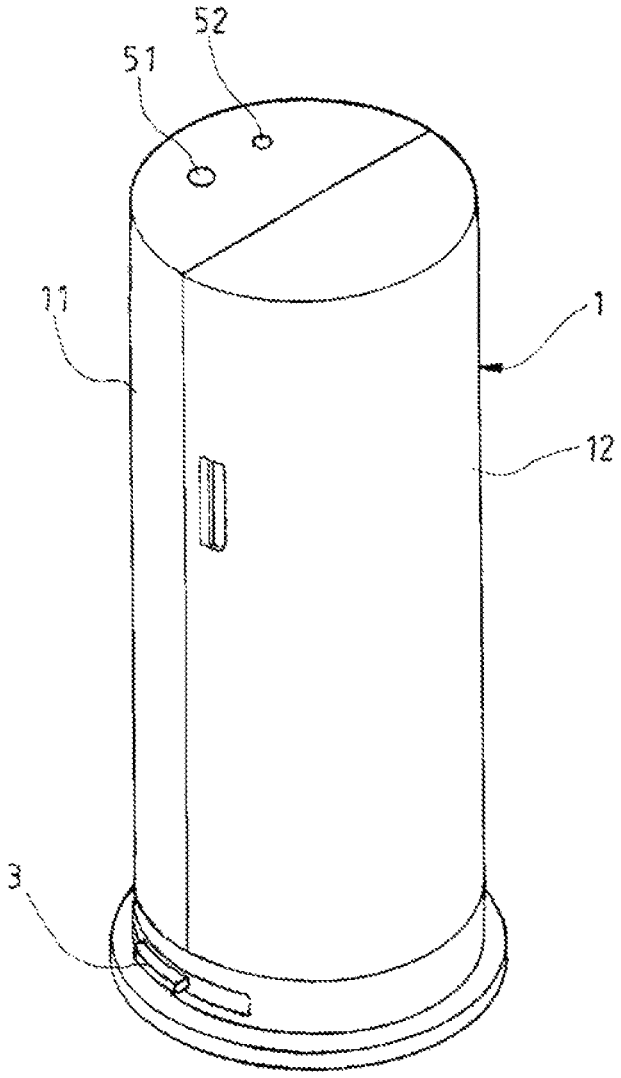
FIG. 4 is a view of the present invention in use.
Figure 5:
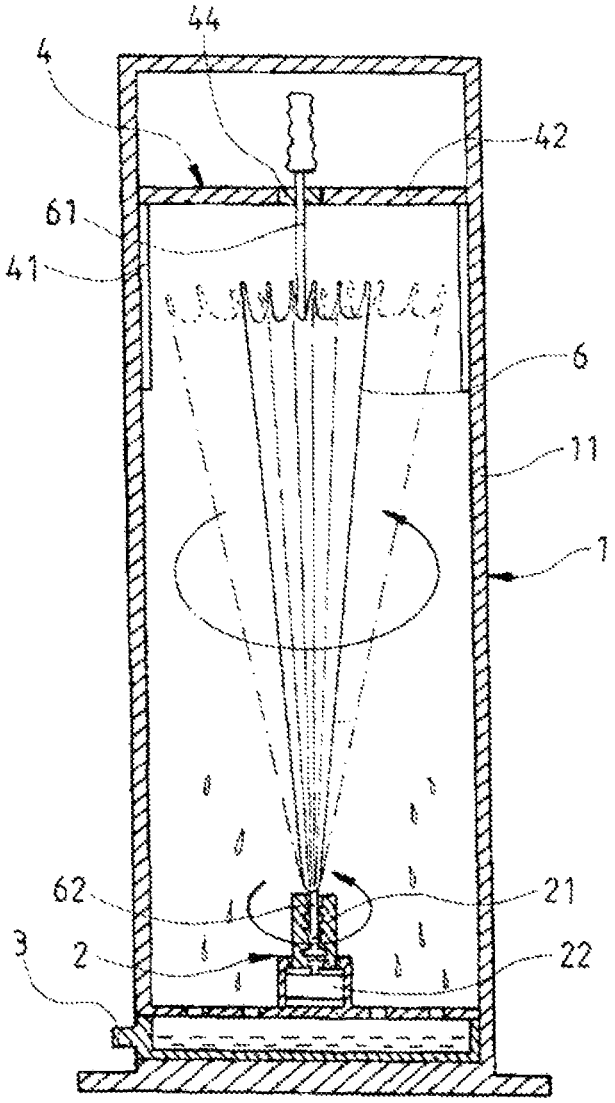
FIG. 5 is a view of the present invention in operation.

Please refer both to FIGS. 4 and 5, showing the present invention in use and in operation. Please also refer to FIGS. 1, 2, and 3. As these figures show, when the present invention is in use, the unity of the two symmetrical semi-circular shell bodies 11 and 12 of the containing cistern body 1 is opened. The crossbar 42 may slide up or down the sliding bar 41 to adjust the level of the positioning component 4 and suit the varying length of an umbrella 6. A top shaft of the umbrella 6 is inserted into the embedding section 21. After the support shaft 61 on the upper part of the umbrella 6 is placed in the positioning component 4, the unity of the shell bodies 11 and 12 is closed and the guide wheels 44 disposed on the positioning component 4 would clamp and position the support bar of the umbrella 6. On the embedding section 21 is disposed a plurality of tapering serrated segments 211, so that when a top shaft 62 of an umbrella 6 of different make is inserted in the embedding section 21, the serrated segments 211 would clamp tightly the top shaft 62 of varying thickness degree. When the unity of the shell bodies 11 and 12 is closed, a press on the button 51 turns on the transmission component 22, which drives the embedding section 21 to rotate quickly. Rainwater on the umbrella is flung outward due to centrifugal force and falls on the bearing plate 3 at a bottom edge of the containing cistern body 1. After the embedding section 21 is driven to rotate quickly by the transmission component 22 for a certain period of time, the display lamp 42 would light up, and the unity of the shell bodies 11 and 12 may be opened for the drained umbrella 6 to be retrieved. The umbrella draining assembly of the present invention drains wet umbrellas carried from outdoor to indoor on rainy days and prevents rainwater thereon to drip on the floor.

During the draining process, if the unity of the shell bodies 11 and 12 is opened by accident, the contact switch 13 would sense an opening signal and stop the action of the transmission component 22 via the control circuit 5 to ensure safety.

The fore-going preferred embodiments of the present invention are illustrated of the present invention rather than limiting of the present invention. It is intended to cover various modifications and changes included within the spirit and scope of the appended claims, the scope of which should be accorded the broadest interpretation so as to encompass all such modifications and similar structures.

In view of the foregoing considerations, the present invention relates to an umbrella draining assembly having a containing cistern body with a bearing plate, a flinging device which may rotate quickly, and a positioning component to fix the position of an umbrella. On rainy days when wet umbrellas are carried from outdoor to indoor, rainwater thereon may be drained by the umbrella draining assembly with easy operation to prevent rainwater from dripping on the floor without use of plastic covers.

What is claimed is:

1. An umbrella draining assembly, comprising:

a containing cistern body composed of a unity of shell bodies which can be opened and shut, with a long opening disposed at an bottom of the containing cistern body for a bearing plate to be placed in;

a positioning component disposed at an inner edge of the shell bodies, which includes a crossbar whereon is disposed a circular frame and on the circular frame is disposed a plurality of symmetrically arrayed flexible guide wheels;

a flinging device disposed inside the containing cistern body which includes an embedding section, in an inner edge of the embedding section is disposed a plurality of tapering serrated segments, and at a bottom edge of the embedding section is disposed a transmission component electrically connected to a control circuit;

when the umbrella draining assembly is in use, the containing cistern body comprising two symmetrical semi-circular shell bodies is opened and a top shaft of an umbrella is inserted into the embedding section; after the unity of the shell bodies is closed, the guide wheels of the positioning component fix the position of the umbrella; the transmission component is then turned on to drive the embedding section to rotate quickly and cause rainwater on the umbrella to fling outward due to centrifugal force and fall on the bearing plate at a bottom edge of the containing cistern body, so that wet umbrellas carried from outdoor to indoor on rainy days are drained and kept from dripping on the floor.

2. The umbrella draining assembly of claim 1, wherein the crossbar of the positioning component is disposed on a sliding bar and may slide up or down along the sliding bar to adjust its level and suit umbrellas of varying length.

3. The umbrella draining assembly of claim 1, wherein the transmission component is a motor.

* * * * *